US008506033B2

(12) United States Patent
Sano

(10) Patent No.: US 8,506,033 B2
(45) Date of Patent: Aug. 13, 2013

(54) PRINTING DEVICE AND PRINTING METHOD

(75) Inventor: Tsuyoshi Sano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 45 days.

(21) Appl. No.: 13/176,550

(22) Filed: Jul. 5, 2011

(65) Prior Publication Data

US 2012/0001973 A1 Jan. 5, 2012

(30) Foreign Application Priority Data

Jul. 5, 2010 (JP) ..... 2010-153253

(51) Int. Cl.
*B41J 29/38* (2006.01)

(52) U.S. Cl.
USPC ..... 347/12

(58) Field of Classification Search
None
See application file for complete search history.

(56) References Cited

U.S. PATENT DOCUMENTS

| | | | | |
|---|---|---|---|---|
| 7,244,021 | B2 | 7/2007 | Arai | |
| 7,407,277 | B2 | 8/2008 | Yoneyama | |
| 2003/0067527 | A1 | 4/2003 | Temple | |
| 2008/0211866 | A1* | 9/2008 | Hill | 347/42 |
| 2010/0238211 | A1* | 9/2010 | Usuda et al. | 347/9 |

FOREIGN PATENT DOCUMENTS

| | | | |
|---|---|---|---|
| JP | 01-127357 | A | 5/1989 |
| JP | 11-188897 | A | 7/1999 |
| JP | 2002-530229 | A | 9/2002 |
| JP | 2003-251916 | A | 9/2003 |
| JP | 2004-306591 | A | 11/2004 |
| JP | 2007-276279 | A | 10/2007 |
| WO | 0030856 | A1 | 6/2000 |

* cited by examiner

*Primary Examiner* — Stephen Meier
*Assistant Examiner* — Tracey McMillion
(74) *Attorney, Agent, or Firm* — Nutter McClennen & Fish LLP

(57) ABSTRACT

A printer includes a moving section that moves an upstream background color nozzles and an upstream color nozzles in either an outward direction or a returning direction from among intersecting directions that intersect the transporting direction, and moves a downstream background color nozzles and a downstream color nozzles in either the outward direction or the returning direction, and a controlling section that makes the upstream background color nozzles and the upstream color nozzles form a background image, and makes at least the downstream color nozzles form a color image, wherein when the background image is formed, regarding the movement of the upstream background color nozzles and the upstream color nozzles in either the outward direction or the returning direction, the upstream background color nozzles and the upstream color nozzles are made to eject the respective inks thereof to tone the background image.

8 Claims, 10 Drawing Sheets

GAMUT DIAGRAM SEEN FROM −b* DIRECTION

GAMUT DIAGRAM SEEN FROM +a* DIRECTION

PRINTING DEVICE AND PRINTING METHOD

Priority is claimed under 35 U.S.C. §119 to Japanese Application No. 2010-153253 filed on Jul. 5, 2010 which is hereby incorporated by reference in its entirety.

BACKGROUND

1. Technical Field

The present invention relates to a printing device and a printing method.

2. Related Art

A printer that forms a background image on a medium and forms a color image on the background image has been developed. For example, when forming a white background image, toning of a background image may be performed by mixing a small amount of colored ink to the background image to achieve the "white" desired by the user. JP-T-2002-530229, JP-A-1-127357, JP-A-2007-276279, JP-A-2003-251916, and JP-A-11-188897 are examples of related art.

However, there was a problem in that, in a case where colored ink lands after a predetermined amount of time passes since white ink is landed, the inks do not mix, and dot granularity of the background image becomes poor. Further, it is desirable to obtain a background image that is appropriately toned by obtaining a wider color reproduction region.

SUMMARY

An advantage of some aspects of the invention is that a background image that is appropriately toned is obtained.

According to an aspect of the invention, there is provided a printing device including: (A) a transporting section that transports a medium in a transporting direction; (B) an upstream side background color nozzle row in which nozzles that eject background color ink to the medium are lined up along the transporting direction; (C) an upstream side color nozzle row that is an upstream side color nozzle row where nozzles that eject colored ink to the medium are lined up along the transporting direction, and where respective nozzles of the upstream side color nozzle row overlap respective nozzles of the upstream side background color nozzle row in the transporting direction; (D) a downstream side background color nozzle row that is a downstream side background color nozzle row provided further in the downstream side of the upstream side background color nozzle row in the transporting direction, and where nozzles that eject the background color ink to the medium are lined up along the transporting direction; (E) a downstream side color nozzle row that is a downstream side color nozzle row where nozzles that eject colored ink to the medium are lined up along the transporting direction, and where respective nozzles of the downstream side color nozzle row overlap respective nozzles of the downstream side background color nozzle row in the transporting direction; (F) a moving section that simultaneously moves the upstream side background color nozzle row and the upstream side color nozzle row in either an outward direction or a returning direction from among intersecting directions that intersect the transporting direction, and simultaneously moves the downstream side background color nozzle row and the downstream side color nozzle row in either the outward direction or the returning direction; and (G) a controlling section that makes the upstream side background color nozzle row and the upstream side color nozzle row form a background image, and makes at least the downstream color nozzle row form a color image, wherein the upstream side background color nozzle row and the upstream side color nozzle row are made to eject the respective inks thereof to tone the background image in the simultaneous movement of the upstream side background color nozzle row and the upstream side color nozzle row in either the outward direction or the returning direction when the background image is formed.

Further, according to another aspect of the invention, there is provided a printing device including: (A) a transporting section that transports a medium in a transporting direction; (B) an upstream side background color nozzle row in which nozzles that eject background color ink to the medium are lined up along the transporting direction; (C) an upstream side color nozzle row that is an upstream side color nozzle row where nozzles that eject colored ink to the medium are lined up along the transporting direction, and where respective nozzles of the upstream side color nozzle row overlap respective nozzles of the upstream side background color nozzle row in the transporting direction; (D) a downstream side background color nozzle row that is a downstream side background color nozzle row provided further in the downstream side of the upstream side background color nozzle row in the transporting direction, and where nozzles that eject the background color ink to the medium are lined up along the transporting direction; (E) a downstream side color nozzle row that is a downstream side color nozzle row where nozzles that eject colored ink to the medium are lined up along the transporting direction, and where respective nozzles of the downstream side color nozzle row overlap respective nozzles of the downstream side background color nozzle row in the transporting direction; (F) a moving section that simultaneously moves the upstream side background color nozzle row and the upstream side color nozzle row in either an outward direction or a returning direction from among intersecting directions that intersect the transporting direction, and simultaneously moves the downstream side background color nozzle row and the downstream side color nozzle row in either the outward direction or the returning direction; and (G) a controlling section that makes the downstream side background color nozzle row and the downstream side color nozzle row form a background image, and makes at least the upstream color nozzle row form a color image, wherein the downstream side background color nozzle row and the downstream side color nozzle row are made to eject the respective inks thereof to tone the background image in the simultaneous movement of the downstream side background color nozzle row and the downstream side color nozzle row in either the outward direction or the returning direction when the background image is formed.

Other characteristics of the invention will be made clear by the specifications and descriptions of the attached drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
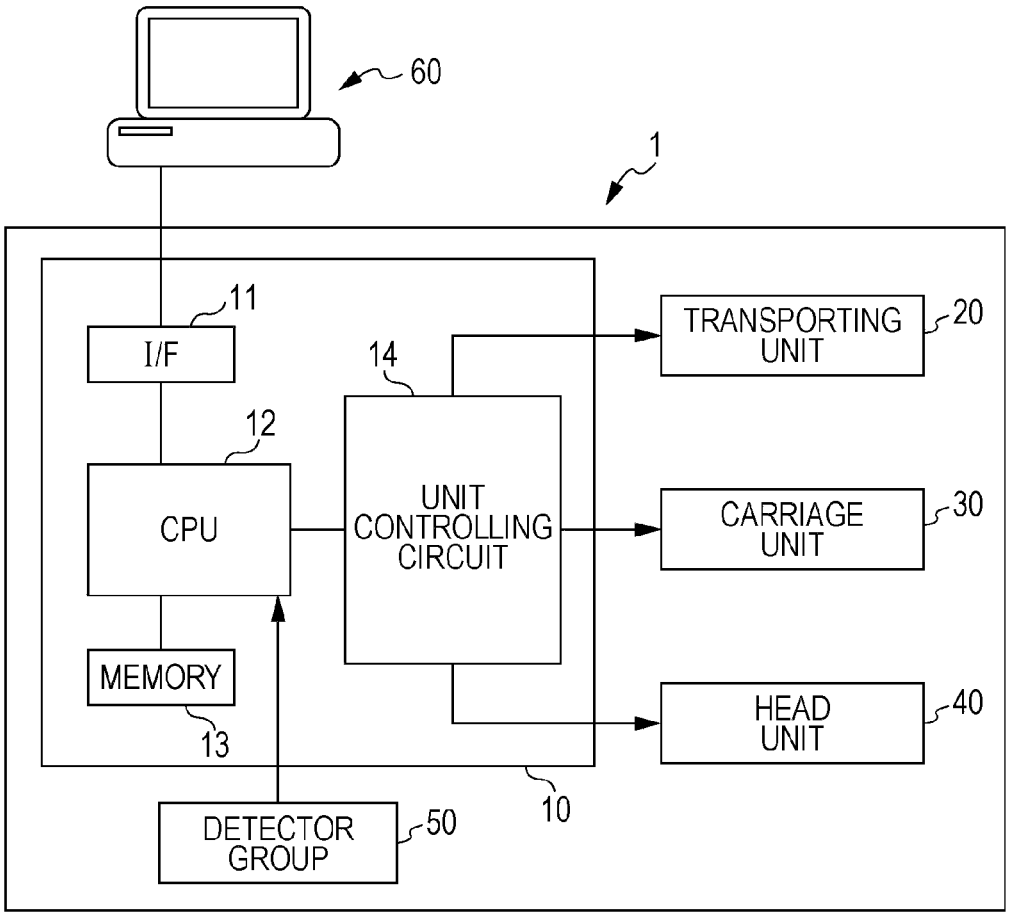
FIG. 1 is an overall configuration block diagram of a printer.

At least the following items will be made clear by the present specification and descriptions of the attached drawings.

A printing device including: (A) a transporting section that transports a medium in a transporting direction; (B) an upstream side background color nozzle row in which nozzles that eject background color ink to the medium are lined up along the transporting direction; (C) an upstream side color nozzle row that is an upstream side color nozzle row where nozzles that eject colored ink to the medium are lined up along the transporting direction, and where respective nozzles of the upstream side color nozzle row overlap respective nozzles of the upstream side background color nozzle row in the transporting direction; (D) a downstream side background color nozzle row that is a downstream side background color nozzle row provided further in the downstream side of the upstream side background color nozzle row in the transporting direction, and where nozzles that eject the background color ink to the medium are lined up along the transporting direction; (E) a downstream side color nozzle row that is a downstream side color nozzle row where nozzles that eject colored ink to the medium are lined up along the transporting direction, and where respective nozzles of the downstream side color nozzle row overlap respective nozzles of the downstream side background color nozzle row in the transporting direction; (F) a moving section that simultaneously moves the upstream side background color nozzle row and the upstream side color nozzle row in either an outward direction or a returning direction from among intersecting directions that intersect the transporting direction, and simultaneously moves the downstream side background color nozzle row and the downstream side color nozzle row in either the outward direction or the returning direction; and (G) a controlling section that makes the upstream side background color nozzle row and the upstream side color nozzle row form a background image, and makes at least the downstream color nozzle row form a color image, wherein the upstream side background color nozzle row and the upstream side color nozzle row are made to eject the respective inks thereof to tone the background image in the simultaneous movement of the upstream side background color nozzle row and the upstream side color nozzle row in either the outward direction or the returning direction when the background image is formed.

By the above, it is possible to obtain a background image that is appropriately toned.

A printing device including: (A) a transporting section that transports a medium in a transporting direction; (B) an upstream side background color nozzle row in which nozzles that eject background color ink to the medium are lined up along the transporting direction; (C) an upstream side color nozzle row that is an upstream side color nozzle row where nozzles that eject colored ink to the medium are lined up along the transporting direction, and where respective nozzles of the upstream side color nozzle row overlap respective nozzles of the upstream side background color nozzle row in the transporting direction; (D) a downstream side background color nozzle row that is a downstream side background color nozzle row provided further in the downstream side of the upstream side background color nozzle row in the transporting direction, and where nozzles that eject the background color ink to the medium are lined up along the transporting direction; (E) a downstream side color nozzle row that is a downstream side color nozzle row where nozzles that eject colored ink to the medium are lined up along the transporting direction, and where respective nozzles of the downstream side color nozzle row overlap respective nozzles of the downstream side background color nozzle row in the transporting direction; (F) a moving section that simultaneously moves the upstream side background color nozzle row and the upstream side color nozzle row in either an outward direction or a returning direction from among intersecting directions that intersect the transporting direction, and simultaneously moves the downstream side background color nozzle row and the downstream side color nozzle row in either the outward direction or the returning direction; and (G) a controlling section that makes the downstream side background color nozzle row and the downstream side color nozzle row form a background image, and makes at least the upstream color nozzle row form a color image, wherein the downstream side background color nozzle row and the downstream side color nozzle row are made to eject the respective inks thereof to tone the background image in the simultaneous movement of the downstream side background color nozzle row and the downstream side color nozzle row in either the outward direction or the returning direction when the background image is formed.

By the above, it is possible to obtain a background image that is appropriately toned.

Further, it is preferable that the upstream side background color nozzle row and the upstream side color nozzle row integrally move in the intersecting direction, and that the downstream side background color nozzle row and the downstream side color nozzle row integrally move in the intersecting direction.

In so doing, it is possible to eject ink drops of the background color nozzle row and ink drops of the color nozzle row without a large time difference.

Further, it is preferable that the controlling section tones a background image that is formed to overlap the color image.

In so doing, it is possible to form a background image that is appropriately toned to the background of a color image.

Further, the controlling section may tone a background image that is not formed to overlap the color image.

In so doing, it is possible to form a 0 background image that is appropriately toned in a region on which a color image is not printed.

Further, it is preferable that the background color ink is white ink.

In so doing, it is possible to form a background image with a white base.

Further, the background color ink may be metallic ink.

In so doing, it is possible to form a background image with a metallic base.

A printing method of a printing device that includes: (A) a transporting section that transports a medium in a transporting direction; (B) an upstream side background color nozzle row in which nozzles that eject background color ink to the medium are lined up along the transporting direction; (C) an upstream side color nozzle row that is an upstream side color nozzle row where nozzles that eject colored ink to the medium are lined up along the transporting direction, and where respective nozzles of the upstream side color nozzle row overlap respective nozzles of the upstream side background color nozzle row in the transporting direction; (D) a downstream side background color nozzle row that is a downstream side background color nozzle row provided further in the downstream side of the upstream side background color nozzle row in the transporting direction, and where nozzles that eject the background color ink to the medium are lined up along the transporting direction; (E) a downstream side color nozzle row that is a downstream side color nozzle row where nozzles that eject colored ink to the medium are lined up along the transporting direction, and where respective nozzles of the downstream side color nozzle row overlap respective nozzles of the downstream side background color nozzle row in the transporting direction; (F) a moving section that simultaneously moves the upstream side background color nozzle row and the upstream side color nozzle row in either an outward direction or a returning direction from among intersecting directions that intersect the transporting direction, and simultaneously moves the downstream side background color nozzle row and the downstream side color nozzle row in either the outward direction or the returning direction; and (G) a controlling section that makes the upstream side background color nozzle row and the upstream side color nozzle row form a background image, and makes at least the downstream color nozzle row form a color image, including toning, by the upstream side background color nozzle row and the upstream side color nozzle row being made to eject the respective inks thereof, in the simultaneous movement of the upstream side background color nozzle row and the upstream side color nozzle row in either the outward direction or the returning direction when the background image is formed.

By the above, it is possible to obtain a background image that is appropriately toned.

Exemplary Embodiments

Hereinbelow, a printing device is an ink jet printer (hereinbelow, printer), and exemplary embodiments will be described with a printing system to which a printer and a computer are connected as an example.

Figure 2:
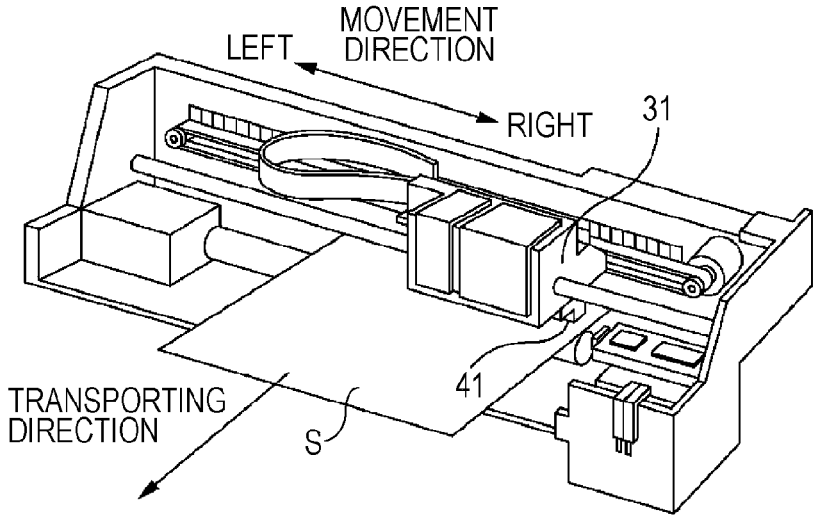
FIG. 2 is a perspective diagram of the printer.

FIG. 1 is an overall configuration block diagram of a printer 1. FIG. 2 is a perspective diagram of the printer 1. A computer 60 is connected to a printer 1 so as to be communicable, and outputs printing data to make the printer 1 print an image to the printer 1. In addition, a program (printer driver) for converting image data output from an application program into printing data is installed on the computer 60. The printer driver may be recorded on a recording medium (recording medium readable by a computer) such as a CD-ROM, or may be downloadable onto a computer via the Internet.

A controller 10 is a controlling unit for performing control of the printer 1. An interface section 11 is for performing transmission and reception of data between the computer 60 and the printer 1. A CPU 12 is an arithmetic processing unit for performing control of the whole of the printer 1. A memory 13 is for securing regions that store programs for the CPU 12, working regions, and the like. The CPU 12 controls each unit by a unit controlling circuit 14. In addition, conditions inside the printer 1 are monitored by a detector group 50, and the controller 10 controls each unit based on the detection results.

A transporting unit 20 is for feeding a medium S to a printable position, and for transporting the medium S in a predetermined transport amount in a transporting direction during printing.

A carriage unit 30 is for moving a head 41 in a moving direction that intersects the transporting direction, and includes a carriage 31.

A head unit 40 is for ejecting ink to the medium S, and includes the head 41. The head 41 moves in the movement direction by the carriage 31. A plurality of nozzles that are ink ejection sections is provided on an undersurface of the head 41, and an ink chamber (not shown) containing ink is provided in each nozzle.

Figure 3:
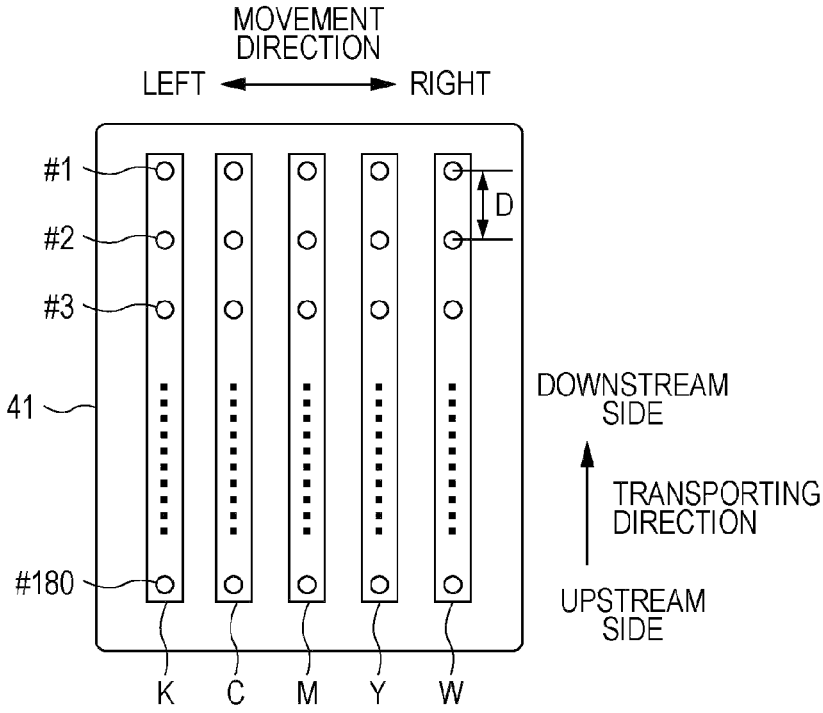
FIG. 3 is a diagram illustrating an arrangement of nozzles provided on an undersurface of a head.

FIG. 3 is a diagram illustrating an arrangement of nozzles provided on the undersurface of the head 41. In addition, the diagram is a virtual view of nozzles from the top of the head 41. On the undersurface of the head 41, 5 rows of nozzle rows, in which 180 nozzles are lined up at predetermined intervals (nozzle pitch D) in the transporting direction, are formed. As shown in the diagram, a black nozzle row K ejecting black ink, a cyan nozzle row C ejecting cyan ink, a magenta nozzle row M ejecting magenta ink, a yellow nozzle row Y ejecting yellow ink, and a white nozzle row W ejecting white ink are lined up in the movement direction. In addition, numbers (#1 to #180) are given to the 180 nozzles included in each nozzle row in ascending order from the downstream side in the transporting direction.

In such a printer 1, a dot forming process, where dots are formed on a medium by intermittently ejecting ink drops from the head 41 which moves along the movement direction, and a transporting process, where the medium is transported in the transporting direction to the head 41, are repeated. By doing so, it is possible to form dots in a later dot forming process on a position on the medium different from a position of dots formed by an earlier dot forming process, and it is possible to print a two-dimensional image on the medium. In addition, an action in which the head 41 moves once in the movement direction while ejecting ink drops (equivalent to one dot forming process/ejecting action) is referred to as a "pass."

Figure 4:
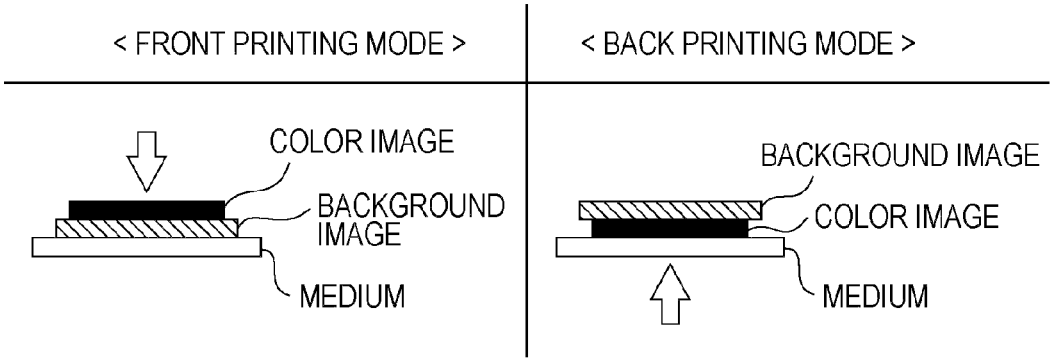
FIG. 4 is a diagram describing a printing mode according to the present embodiment.

FIG. 4 is a diagram describing a printing mode according to the present embodiment. The printer 1 is able to form an image on a medium by either mode of a "front printing mode" in which a color image is printed so as to be seen from the printing surface side, and a "back printing mode" in which a color image is printed so as to be seen from the medium side (opposite side to the image forming side).

Since a color image and a background image are printed to overlap one another, the background image is first printed on a predetermined region of the medium and the color image is printed over this background image in the front printing mode. Conversely, in the back printing mode, the color image is first printed on a predetermined region of the medium and the background image is printed over this color image.

In addition, here, although a printing mode in which a color image and a background image are printed to overlap one another has been described, there are cases where only the background image is printed or cases where only the color image is printed, depending on the printing region.

Figure 5A:
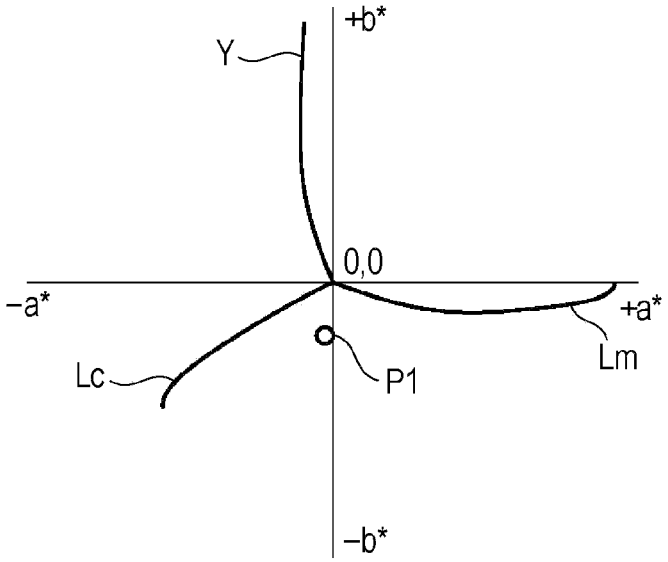
FIG. 5A is an explanatory diagram illustrating the concept of white toning that tones white (part 1)
Figure 5B:
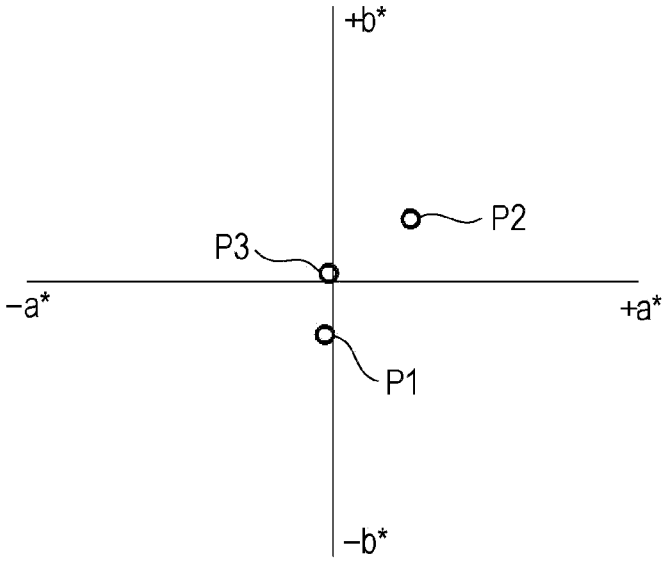
FIG. 5B is an explanatory diagram illustrating the concept of white toning that tones white (part 2).

FIG. 5A is an explanatory diagram illustrating the concept of white toning that tones white (part 1). In FIG. 5A, one example of a position P1 of the color of the white ink of the printer 1 is shown on a plane a*–b*. FIG. 5B is an explanatory diagram illustrating the concept of white toning that tones white (part 2). In FIG. 5B, further, one example of a position P2 of a target white and a position P3 of a color in which a predetermined amount of yellow ink is mixed to the white ink of the printer 1 is shown. As shown in FIG. 5B, for example, by mixing yellow ink to the white ink of the printer 1, it is possible to bring the color of a background image (toned white image) closer to the target white. Further, if it is possible to eject light magenta ink, by further mixing predetermined amounts of light magenta and yellow ink, it is possible to bring the color of a background image even closer to the target white. In this manner, by using white ink and ink of at least one color other than white when forming a background image, it is possible to make the color of the background image a desired color.

Figure 6A:
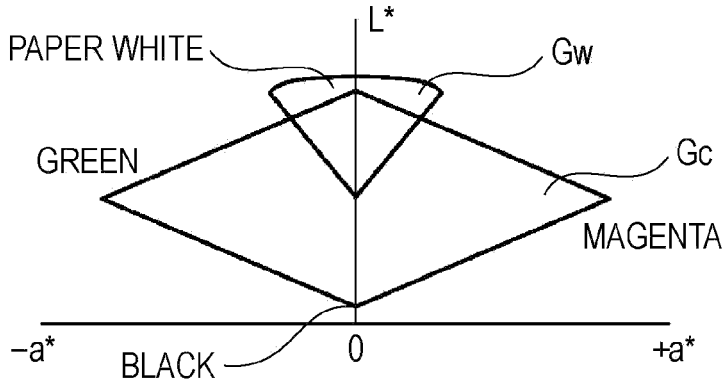
FIG. 6A is an explanatory diagram illustrating an example of a color reproduction region (gamut) of a color image and a background image (part 1)
Figure 6B:
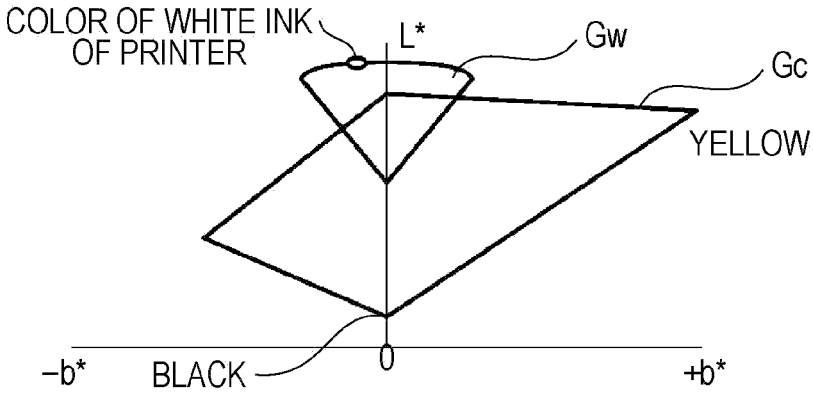
FIG. 6B is an explanatory diagram illustrating an example of a color reproduction region (gamut) of a color image and a background image (part 2).

FIG. 6A is an explanatory diagram illustrating an example of a color reproduction region (gamut) of a color image and a background image (part 1). In FIG. 6A, a gamut Gc of a color image and a gamut Gw of a background image are shown seen from a –b* direction. FIG. 6B is an explanatory diagram illustrating an example of a color reproduction region (gamut) of a color image and a background image (part 2). In FIG. 6B, a gamut Gc of a color image and a gamut Gw of a background image are shown seen from a +a* direction.

In the present embodiment, inks of the four colors excluding white are used in the formation of a color image, and white ink is not used. Further, in the formation of a background image, inks of the five colors of white, yellow, black, cyan, and magenta are used.

In addition, in the case of a printer that includes ink of light cyan or light magenta, toning may be performed by using light cyan and light magenta instead of cyan and magenta.

Printing Pattern 1

Figure 7:
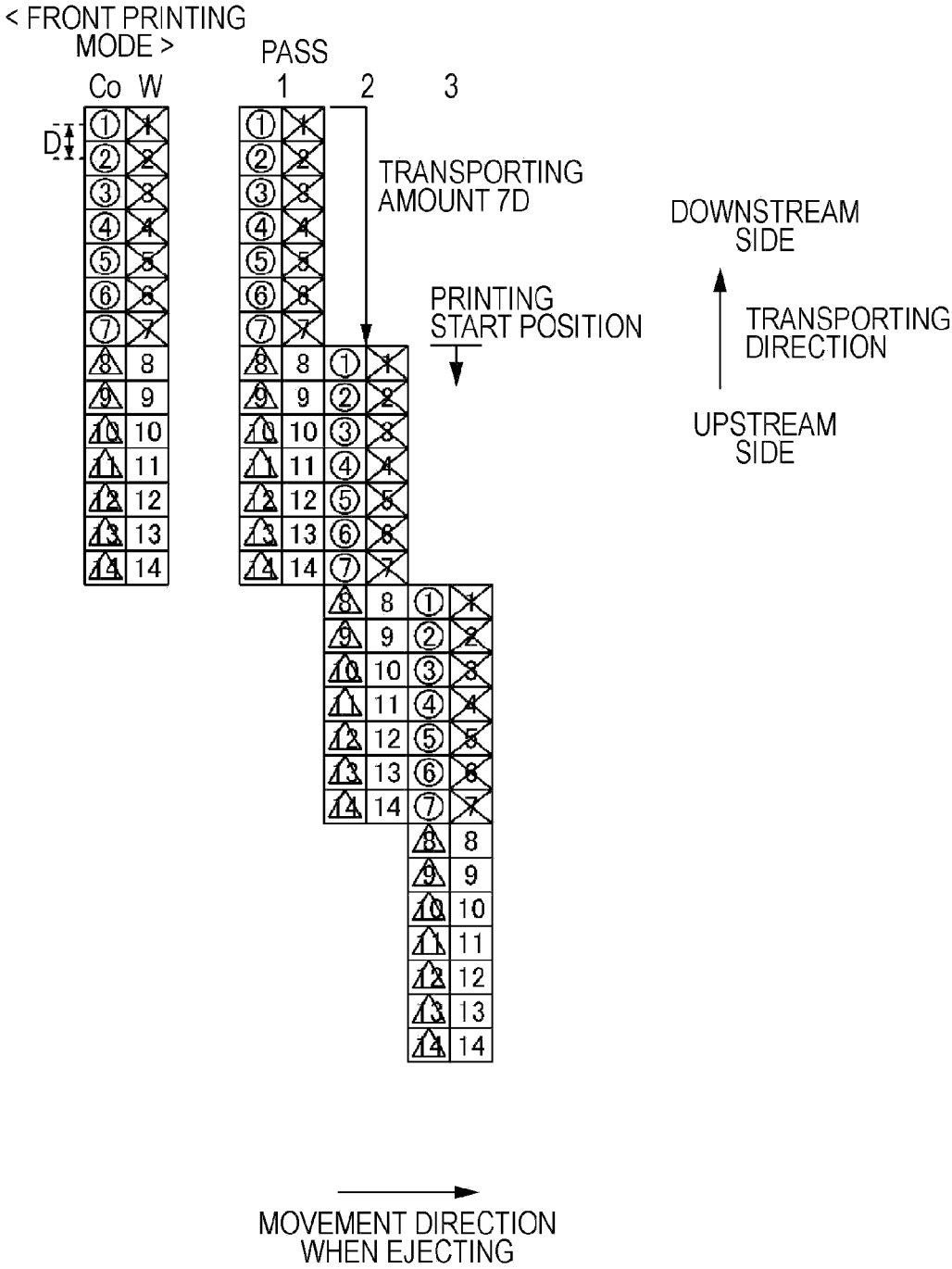
FIG. 7 is an explanatory diagram of a printing pattern 1 of a front printing mode.
Figure 8:
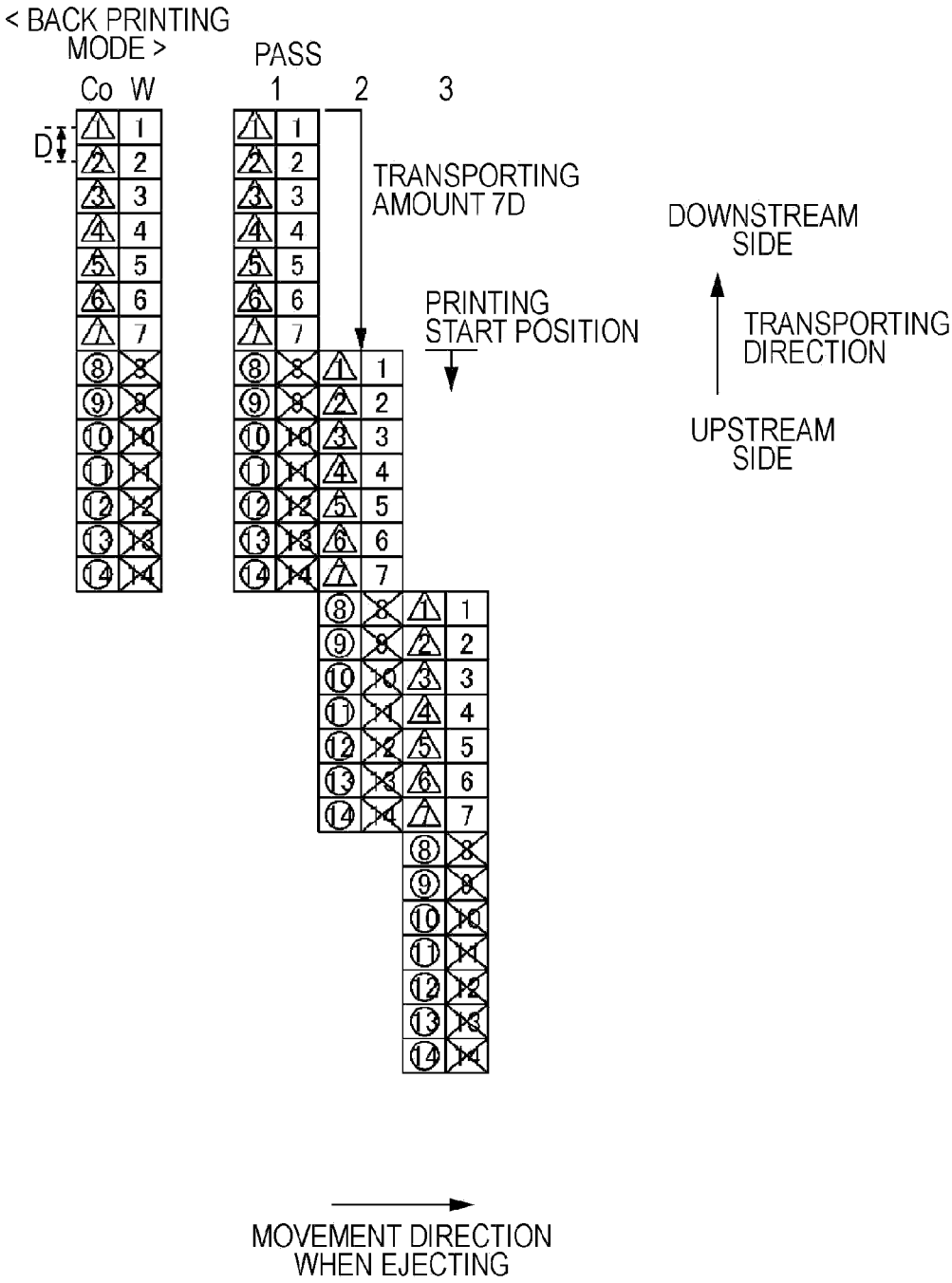
FIG. 8 is an explanatory diagram of a printing pattern 1 of a back printing mode.

FIG. 7 is an explanatory diagram of a printing pattern 1 of a front printing mode. FIG. 8 is an explanatory diagram of a printing pattern 1 of a back printing mode. For the sake of simplicity, the diagrams are drawn with the number of nozzles belonging to each nozzle row reduced to 14. Further, nozzle rows ejecting each of the four colors (YMCK) are together shown as "color nozzle row Co." FIGS. 7 and 8 show band printing. Band printing is a printing method in which band images formed by one pass are lined up in the transporting direction, and is a printing method in which no raster lines are formed during other passes between raster lines formed in a given pass (dot rows along a movement direction).

Incidentally, if a background image is printed using only white ink, the color itself of the color of the white ink that prints the background image becomes the background color. However, even with inks described as white ink in the same manner, there are slight differences in the color of white depending on the materials and the like of the ink. For this reason, there are cases where, depending on the white ink used, a background image of a color different to a color desired by a user may be printed. Further, depending on the printed matter, a background image that has a slight chromatic color instead of simply white may be desired. Further, in a case where a white medium is used, even with the white media, there are slight differences in the color of white depending on the types of media. For this reason, when printing a background image on a white medium, if the white of the background image and the white of the medium are different, the background image stands out.

Therefore, in the present embodiment, as described above, a desired white background image (adjusted white background image) is printed by appropriately using small amounts of colored ink (YMCK) along with white ink. That is, when printing a background image, colored ink of at least one color among the colored inks ejectable by the printer 1 may be used, and for example, all four colors of colored ink may be used or two colors of colored ink may be used. In this manner, by printing the background image with white ink and colored ink, in a case where white ink has a slight tint, by printing the background image with ink that negates this tint, it is possible to make the background image closer to an achromatic color.

In addition, printing data for making the printer 1 print a desired white background image may be recorded in advance on the printer 1, or may be created by the printer driver. In a case where selection of a desired color of a background image is performed by a user such as by looking at a monitor of the printer 1 or a computer screen, printing data of a background image corresponding to the selected color may be made to be generated.

In the front printing mode of FIG. 7, a background image is first printed on a predetermined region of a medium, and a color image is printed thereon. For this reason, half of the nozzles (#8 to #14 (nozzle numbers have no symbols), hereinafter, white nozzles forming background images are referred to as such) in the upstream side in the transporting direction of a white nozzle row W and half of the nozzles (#8 to #14 (nozzle numbers are enclosed in triangles), hereinafter, color nozzles used for toning are referred to as such) in the upstream side in the transporting direction of a color nozzle row are the nozzles used for printing a background image, and half of the nozzles (#1 to #7 (nozzle numbers are enclosed in circles), hereinafter, color nozzles forming color images are referred to as such) in the downstream side in the transporting direction of a color nozzle row Co are the nozzles used for printing a color image. In addition, in the front printing mode, ink is not ejected from half of the nozzles (#1 to #7 ("X" is marked on the nozzle numbers), hereinafter, unused white nozzles are referred to as such) in the downstream side in the transporting direction of the white nozzle row W. Further, since FIG. 7 is band printing, each medium transporting amount becomes a length 7D which is one half of a nozzle row (length corresponding to 7 nozzles).

That is, in the front printing mode, the action of forming an image using the nozzles used in the upstream side in the transporting direction of the white nozzle row W, the nozzles used in the upstream side in the transporting direction of the color nozzle row Co, and the nozzles used in the downstream side in the transporting direction of the color nozzle row Co, and the action of transporting a medium by only the transporting amount 7D are repeated. As a result, a predetermined region of the medium first faces the nozzles (#8 to #14) used in the upstream side in the transporting direction of the white nozzle row W and the color nozzle row Co, and a background image is formed on the predetermined region of the medium. In addition, at this time, since ink is ejected while moving in the movement direction when ejecting as shown in the diagram, the white ink lands on the medium slightly before the color ink for toning.

Thereafter, by transporting the medium to the downstream side in the transporting direction, the predetermined region of the medium faces the nozzles (#1 to #7) used in the downstream side in the transporting direction of the color nozzle row Co, and a color image is printed on the background image of the predetermined region of the medium.

Conversely, in the back printing mode, as shown in FIG. 8, half of the nozzles (#1 to #7 (nozzle numbers have no symbols)) in the downstream side in the transporting direction of the white nozzle row W and half of the nozzles (#1 to #7 (nozzle numbers are enclosed in triangles)) in the downstream side in the transporting direction of the color nozzle row Co are the nozzles used for printing a background image, and half of the nozzles (#8 to #14 (nozzle numbers are enclosed in circles)) in the upstream side in the transporting direction of the color nozzle row Co are the nozzles used for printing a color image. In addition, each medium transporting amount is the length 7D which is one half of a nozzle row. As a result, a predetermined region of the medium first faces the nozzles (#8 to #14) used in the upstream side in the transporting direction of the color nozzle row Co, and a color image is formed in the predetermined region of the medium. Thereafter, by transporting the medium to the downstream side in the transporting direction, the predetermined region of the medium faces the nozzles (#1 to #7) used in the downstream side in the transporting direction of the white nozzle row W and the color nozzle row Co, and a background image is printed on the color image of the predetermined region of the medium.

In this manner, the positions in the transporting direction of the nozzles (nozzle numbers have no symbols) of the white nozzle row W that print a background image and the positions in the transporting direction of the nozzles (nozzle numbers are enclosed in triangles) of the color nozzle row Co that similarly print a background image are made to be the same. By doing so, white ink and colored ink are ejected in the same pass onto a predetermined region of a medium in order to print a background image. As a result, the white ink and colored ink are mixed and it is possible to reduce the sense of granularity of the background image.

Further, when forming a background image, colored ink for toning is ejected to pixels on which white ink is ejected in the same pass. By doing so, when performing toning, since the white ink and the colored ink for toning land on the same pixels at approximately the same timing (in reality, the colored ink lands slightly later than the white ink) in the same pass, both are mixed to an appropriate extent and a wide color reproduction region is able to be obtained. Thus, a high brightness and high saturation color is realized, and it is possible to form a background that is appropriately adjusted.

Further, the proportion of colored ink configuring a background image is small in comparison to the proportion of white ink. However, in order to reduce the sense of granularity of the colored ink in a background image, it is preferable that the dots of the colored ink be dispersed as evenly as possible. That is, colored ink density (dot density) per unit region of background image is made to be small in relation to white ink density (dot density) per unit region of background image. For this reason, although the proportion of colored ink configuring a background image is small in comparison to the proportion of white ink, in the present embodiment, the number of nozzles of the white nozzle row W used for printing a background image and the number of nozzles of the color nozzle row Co are made to be equal. That is, a background image is printed using half of the nozzles belonging to the color nozzle row Co. However, without limiting thereto, a background image may be formed using one out of every few nozzles out of the half of the nozzles of the color nozzle row Co usable for printing a background image.

In addition, although description of a case of toning a background image that is formed to overlap a color image has been given in the embodiment described above, even a case of toning a background image that is not formed to overlap a color image is able to be performed with approximately the same actions.

Further, although the background image of a white base has been described, the background image may be of a metallic base by replacing the white nozzle row W with metallic nozzles ejecting metallic ink.

Printing Pattern 2

Figure 9:
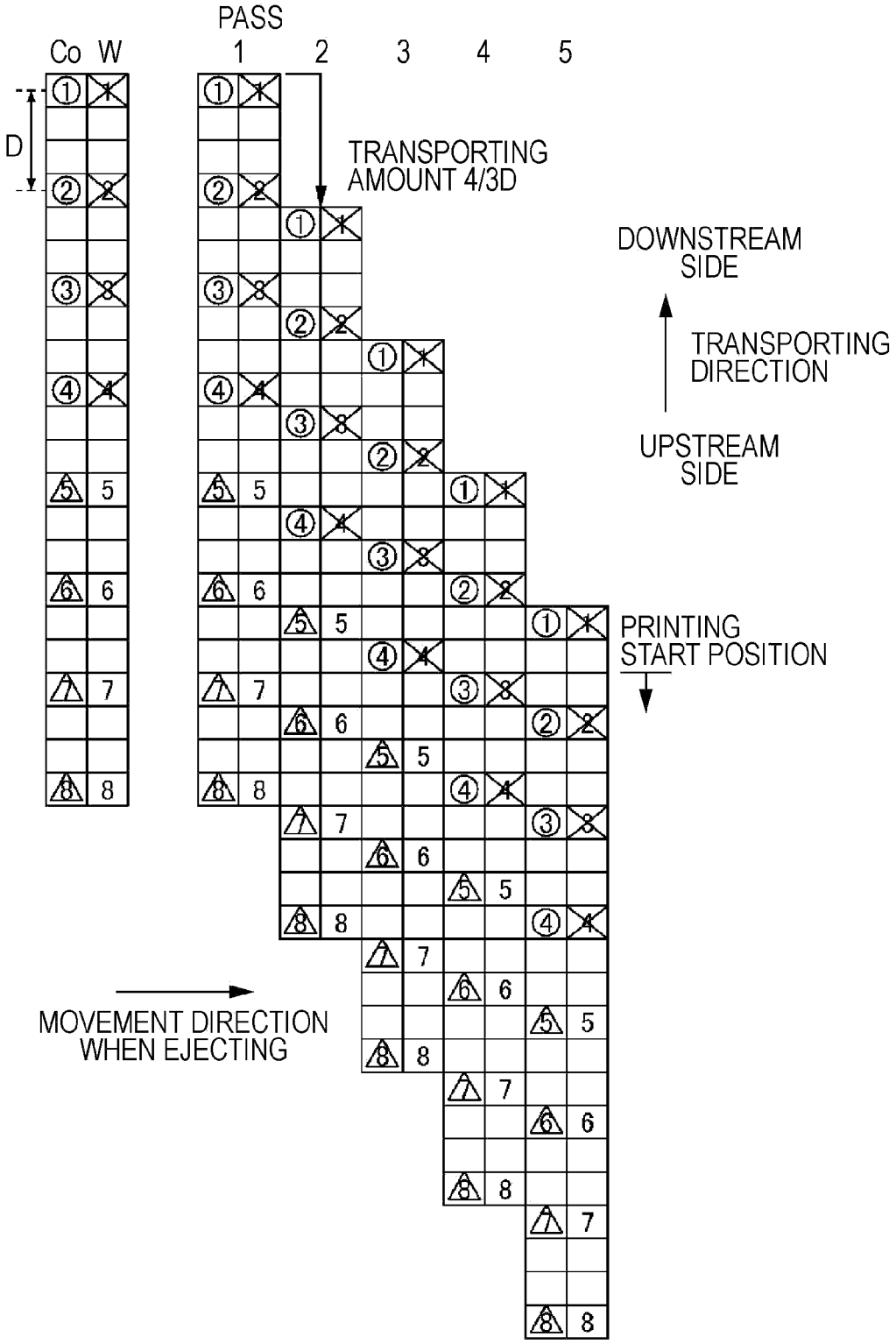
FIG. 9 is an explanatory diagram of a printing pattern 2 of a front printing mode.

FIG. 9 is an explanatory diagram of a printing pattern 2 of a front printing mode. Again, for the sake of simplicity, the diagram is drawn with the number of nozzles belonging to each nozzle row as 8. In addition, the meanings of the symbols attached to each nozzle number are the same as those of the printing pattern 1 described above.

Even if printing like that shown in FIG. 9 is performed, it is possible to obtain a background image and a color image which are toned in the same manner as described above. Further, in a case where such a medium is transported, since so-called interlace printing is configured, it is possible to reduce banding unevenness by dispersing the nozzles used.

In addition, in a case where the back printing mode is performed in the printing pattern 2, the upstream side color nozzle row shown with triangles is used as the nozzle row for printing a color image, and ink is not ejected from the upstream side white nozzle row to which no symbols are attached. Further, the downstream side color nozzle row shown with the circle symbols is the color nozzle row used for toning, and the downstream side white nozzle row shown with the "X" symbol is the nozzle row for printing a background image. In addition to doing so, by performing the same transportation as in FIG. 9, printing by the back printing mode is able to be performed. In addition, when performing the back printing mode, the movement direction when ejecting may be made to be the left side of a paper face that is opposite to the direction shown in FIG. 9.

Printing Pattern 3

Figure 10:
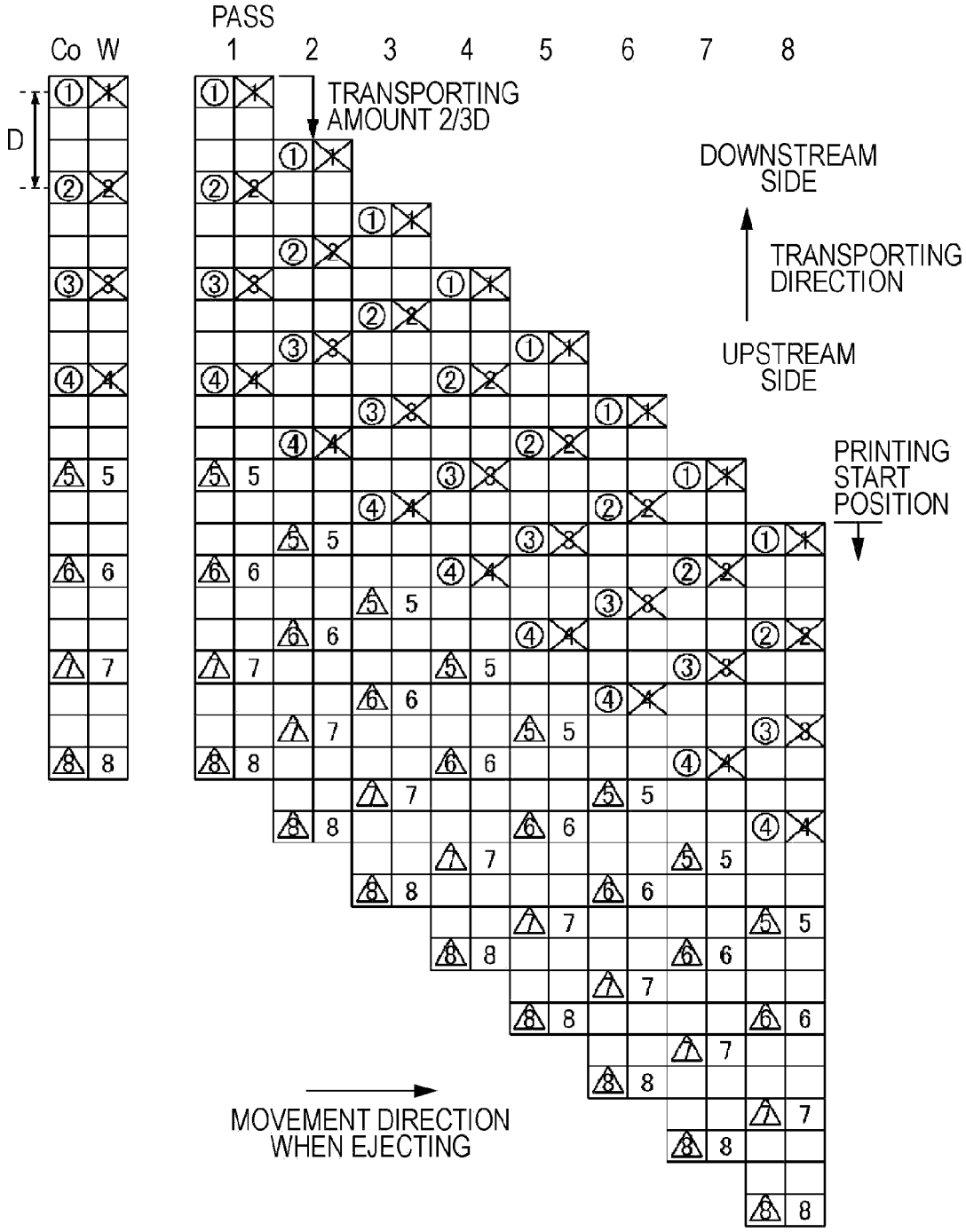
FIG. 10 is an explanatory diagram of a printing pattern 3 of a front printing mode.

FIG. 10 is an explanatory diagram of a printing pattern 3 of a front printing mode. Here, although the same nozzle arrangement as the printing pattern 2 is used, the transporting amount is different. Then, if the nozzles used which relate to the printing start position and thereafter are referenced, it can be seen that nozzles for forming color images (those enclosed in circles) pass twice for one raster line. That is to say, in so doing, in relation to color images, so-called overlap printing is able to be performed. In so doing, it is still possible to obtain a background image and a color image toned in the same manner described above.

In addition, in terms of the handling of the nozzles used in a case where the back printing mode is performed in the printing pattern 3, the nozzles used are switched in the same manner as in the printing pattern 2 described above. By doing so, it is also possible to realize the back printing mode.

Printing Pattern 4

Figure 11:
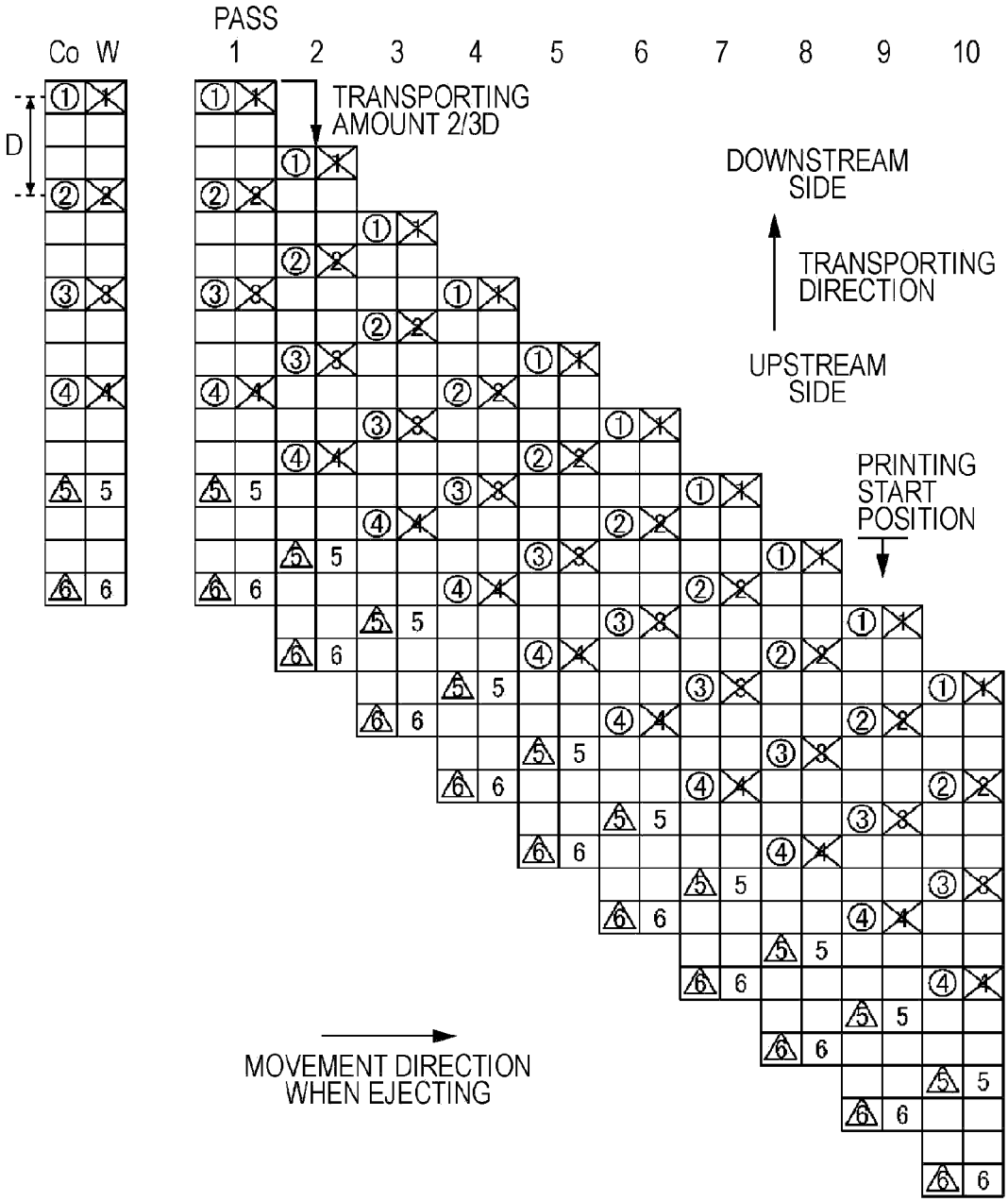
FIG. 11 is an explanatory diagram of a printing pattern 4 of a front printing mode.

FIG. 11 is an explanatory diagram of a printing pattern 4 of a front printing mode. Although the number of nozzles of the upstream side and the number of nozzles of the downstream side have been made to be equal in the printing patterns 1 to 3 described above, a configuration in which the number of nozzles of the upstream side and the number of nozzles of the downstream side are different as in the printing pattern 4 is possible.

In so doing, it is still possible to obtain a background image and a color image which are toned appropriately in the same manner described above.

Printing Pattern 5

Figure 12:
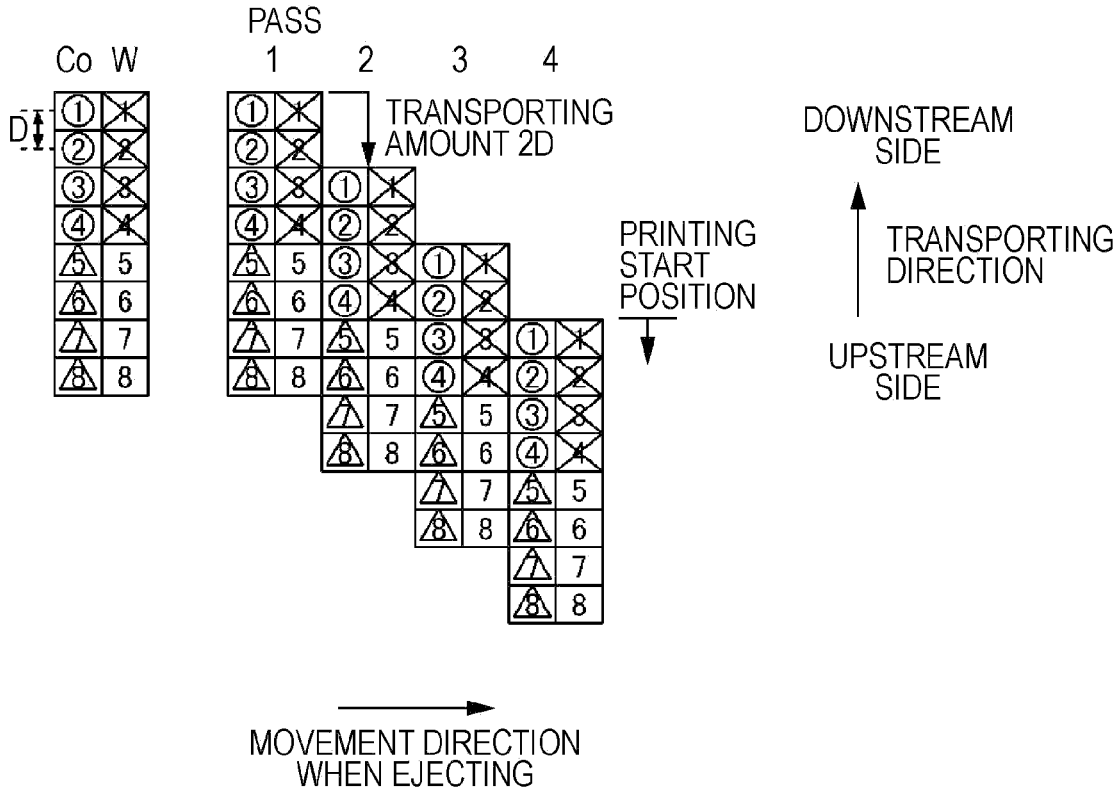
FIG. 12 is an explanatory diagram of a printing pattern 5 of a front printing mode.

FIG. 12 is an explanatory diagram of a printing pattern 5 of a front printing mode. If the nozzles of the printing start position and thereafter are referenced, it can be seen that the white nozzles for forming a background image and the color nozzles for performing toning pass twice for one raster line. That is to say, in so doing, so-called overlap printing is still able to be performed in relation to background images.

Other Embodiments

In the embodiment described above, although upstream side nozzle rows and downstream side nozzle rows on one head have been used and described, the head is not limited to one. For example, it is possible to provide a first head in the upstream side and a second head in the downstream side. Each head includes a colored ink nozzle rows and a white nozzle row. In so doing, it is still possible to make the colored ink nozzle rows and the white nozzle row of the first head be upstream side nozzle rows, and to make the colored ink nozzle rows and the white nozzle row of the second head be downstream side nozzle rows.

Further, a printing method such as the following may be an embodiment.

A printing method of a printing device that includes: (A) a transporting section that transports a medium in a transporting direction; (B) an upstream side background color nozzle row in which nozzles that eject background color ink to the medium are lined up along the transporting direction; (C) an upstream side color nozzle row that is an upstream side color nozzle row where nozzles that eject colored ink to the medium are lined up along the transporting direction, and where respective nozzles of the upstream side color nozzle row overlap respective nozzles of the upstream side background color nozzle row in the transporting direction; (D) a downstream side background color nozzle row that is a downstream side background color nozzle row provided further in the downstream side of the upstream side background color nozzle row in the transporting direction, and where nozzles that eject the background color ink to the medium are lined up along the transporting direction; (E) a downstream side color nozzle row that is a downstream side color nozzle row where nozzles that eject colored ink to the medium are lined up along the transporting direction, and where respective nozzles of the downstream side color nozzle row overlap respective nozzles of the downstream side background color nozzle row in the transporting direction; (F) a moving section that simultaneously moves the upstream side background color nozzle row and the upstream side color nozzle row in either an outward direction or a returning direction from among intersecting directions that intersect the transporting direction, and simultaneously moves the downstream side background color nozzle row and the downstream side color nozzle row in either the outward direction or the returning direction; and (G) a controlling section that makes the downstream side background color nozzle row and the downstream side color nozzle row form a background image, and makes at least the upstream color nozzle row form a color image, including toning, by the downstream side background color nozzle row and the downstream side color nozzle row being made to eject the respective inks thereof, in the simultaneous movement of the downstream side background color nozzle row and the downstream side color nozzle row in either the outward direction or the returning direction when the background image is formed.

Further, although the printer 1 has been described in the embodiment described above, the embodiment is not limited thereto, and may be realized as a liquid discharging device that ejects or discharges a liquid other than ink (liquids, liquid bodies in which particles of functional materials are dispersed, gel-like liquid bodies). For example, the same techniques as those of the embodiment described above may be adopted for various types of devices applying ink jet techniques such as a color filter manufacturing device, a dyeing device, a microfabrication device, a semiconductor manufacturing device, a surface treatment device, a three-dimensional modeling device, a vaporizer, an organic EL manufacturing device (particularly a high polymer EL manufacturing device), a display manufacturing device, a coating device, and a DNA chip manufacturing device. Further, these methods and manufacturing methods are also within the scope of the range of applications.

Further, the embodiment described above is for making understanding of the invention easier, and is not for interpreting to limit the invention. It is needless to say that the invention may be altered or improved without departing from the gist thereof, and that the invention includes the equivalents thereof.

White

In addition, "white" in the present specification is not limited to white in a strict sense as a surface color of an object that reflects 100% of the wavelengths of visible rays, and includes a so-called "whitish color" that is a color commonly referred to as white. "White" is, for example, (1) a color in which the title in a Lab system is a circumference of a radius 20 and on the inside thereof on a plane a*b*, and is within a color phase range represented by L* of 70 or greater in a case where, using the X-Rite, Inc. colorimeter EyeOne Pro, colorimetry mode: spot colorimetry, light source: D50, backing: Black, and print medium: transparent film, (2) a color in which the title in a Lab system is a circumference of a radius 20 and on the inside thereof on a plane a*b*, and is within a color phase range represented by L* of 70 or greater in a case where, using the Minolta colorimeter CM-2022, color is measured with measurement mode D502° viewing angle, SCF mode, and a white background, or (3) a color of ink used as the background of an image as described in JP-A-2004-306591, and "white" is not limited to pure white if it is used as a background.

Head

In the embodiment described above, ink was discharged using a piezoelectric element. However, the method of discharging liquids is not limited thereto. Other methods, for example, a method of generating bubbles in the nozzles by heating and the like, may be used.

What is claimed is:

1. A printing device comprising:

(A) a transporting section that transports a medium in a transporting direction;

(B) an upstream side background color nozzle that ejects background color ink to the medium;

(C) an upstream side color nozzle that ejects colored ink to the medium;

(D) a downstream side background color nozzle that is provided further in the downstream side of the upstream side background color nozzle row in the transporting direction, and ejects the background color ink to the medium;

(E) a downstream side color nozzle that is provided further in the downstream side of the upstream side color nozzle in the transporting direction, and ejects the color ink to the medium;

(F) a moving section that moves the upstream side background color nozzle, the upstream side color nozzle, the downstream side background color nozzle, and the downstream side color nozzle, in intersecting directions that intersect the transporting direction; and (G) a controlling section that makes the upstream side background color nozzle and the upstream side color nozzle form a background image by moving the upstream side background color nozzle and the upstream side color nozzle in the intersecting directions, and makes at least the downstream color nozzle form a color image, by moving the downstream color nozzle in the intersecting directions, wherein the upstream side background color nozzle and the upstream side color nozzle are made to eject the respective inks thereof to tone the background image, when the background image is formed;

wherein an area where image is formed by the upstream side background color nozzle and an area where image is formed by the upstream side color nozzle overlap partially at least.

2. A printing device comprising:

(A) a transporting section that transports a medium in a transporting direction;

(B) an upstream side background color nozzle that ejects background color ink to the medium;

(C) an upstream side color nozzle that ejects colored ink to the medium;

(D) a downstream side background color nozzle that is provided further in the downstream side of the upstream side background color nozzle in the transporting direction, and ejects the background color ink to the medium;

(E) a downstream side color nozzle that is provided further in the downstream side of the upstream side color nozzle in the transporting direction, and ejects the color ink to the medium;

(F) a moving section that moves the upstream side background color nozzle, the upstream side color nozzle, the downstream side background color nozzle, and the downstream side color nozzle in intersecting directions that intersect the transporting direction; and (G) a controlling section that makes the upstream side background color nozzle and the upstream side color nozzle form a background image by moving the upstream side background color nozzle and the upstream side color nozzle in the intersecting directions, and makes at least the downstream color nozzle form a color image, by moving the downstream color nozzle in the intersecting directions, wherein the upstream side background color nozzle and the upstream side color nozzle are made to eject the respective inks thereof to tone the background image, when the background image is formed, wherein an area where image is formed by the downstream side background color nozzle and an area where image is formed by the downstream side color nozzle overlap partially at least, when the background image is formed.

3. The printing device according to claim 1, wherein the upstream side background color nozzle and the upstream side color nozzle integrally move in the intersecting direction, and the downstream side background color nozzle and the downstream side color nozzle integrally move in the intersecting direction.

4. The printing device according to claim 1, wherein the controlling section tones a background image that is formed to overlap the color image.

5. The printing device according to claim 1, wherein the controlling section tones a background image that is not formed to overlap the color image.

6. The printing device according to claim 1, wherein the background color ink is white ink.

7. The printing device according to claim 1, wherein the background ink is metallic ink.

8. A printing method of a printing device that includes:

(A) a transporting section that transports a medium in a transporting direction;

(B) an upstream side background color nozzle that ejects background color ink to the medium;

(C) an upstream side color nozzle that ejects colored ink to the medium;

(D) a downstream side background color nozzle that is provided further in the downstream side of the upstream side background color nozzle in the transporting direction, and ejects the background color ink to the medium;

(E) a downstream side color nozzle that is provided further in the downstream side of the upstream side color nozzle in the transporting direction, and ejects the color ink to the medium;

(F) a moving section that moves the upstream side background color nozzle, the upstream side color nozzle, the downstream side background color nozzle, and the downstream side color nozzle in intersecting directions that intersect the transporting direction; and (G) a controlling section that makes the upstream side background color nozzle and the upstream side color nozzle form a background image by moving the upstream side background color nozzle and the upstream side color nozzle in the intersecting directions, and makes at least the downstream color nozzle form a color image, by moving the downstream color nozzle in the intersecting directions wherein the upstream side background color nozzle and the upstream side color nozzle are made to eject the respective inks thereof to tone the background image, when the background image is formed, and wherein an area where image is formed by the upstream side background color nozzle and an area where image is formed by the upstream side color nozzle overlap partially at least, when the background image is formed.

* * * * *